US005089031A

United States Patent [19]

Kikuchi et al.

[11] Patent Number: 5,089,031

[45] Date of Patent: Feb. 18, 1992

[54] COAL GASIFICATION APPARATUS USING COAL POWDER

[75] Inventors: Kenichi Kikuchi, Yokohama; Akio Suzuki, Kawasaki; Tetsuro Mochizuki, Yokohama, all of Japan

[73] Assignee: Nippon Kokan Kabushiki Kaisha, Tokyo, Japan

[21] Appl. No.: 582,008

[22] Filed: Sep. 14, 19900890318310024863

[51] Int. Cl.[5] ..... C10J 3/56

[52] U.S. Cl. ..... 48/77; 48/63

[58] Field of Search ..... 48/77, 202, 206, 40, 48/203, DIG. 4, 63, 64, 76

[56] References Cited

U.S. PATENT DOCUMENTS

| | | | |
|---|---|---|---|
| 2,677,603 | 5/1954 | Van Loon | 48/76 |
| 2,803,530 | 8/1957 | Ludeman | 48/DIG. 4 |
| 3,454,383 | 7/1969 | Pirsh et al. | 48/203 |
| 3,884,649 | 5/1975 | Matthews | 48/202 |
| 3,932,146 | 1/1976 | Wilson | 48/210 |
| 4,531,949 | 7/1985 | Koyama et al. | 48/DIG. 4 |
| 4,696,678 | 9/1987 | Koyama et al. | 48/206 |
| 4,721,514 | 1/1988 | Kikuchi et al. | 48/206 |

*Primary Examiner*—Peter Kratz

*Attorney, Agent, or Firm*—Fleit, Jacobson, Cohn, Price, Holman & Stern

[57] ABSTRACT

A coal gasification apparatus using coal powder supplies coal powder, along with oxygen or air and steam, into a reaction chamber, supplies the char produced in the reaction chamber or the char and coal, along with oxygen or air and steam into a combustion chamber formed in the lower part of the reaction chamber and burns the same in the combustion chamber to maintain the temperature therein at about 1,600° C., and forms the temperature region of the reaction chamber into an agglomerated bed of fluidized coal having a temperature between 900° and 1,300° C.

4 Claims, 3 Drawing Sheets

COAL GASIFICATION APPARATUS USING COAL POWDER

This application is a continuation of application Ser. No. 07/398,322, filed Aug. 24, 1989, which is a continuation of application Ser. No. 275,649, filed on Nov. 23, 1988, now abandoned, which is a continuation of application Ser. No. 143,233, filed on Jan. 6, 1988, now abandoned, which is a continuation of application Ser. No. 800,912, filed Nov. 25 1985, now abandoned, which is a continuation-in-part of application Ser. No. 538,286, filed Oct. 3, 1983, now abandoned, which is a divisional of application Ser. No. 316, 529, filed Oct. 29, 1981, now abandoned.

BACKGROUND OF THE INVENTION.

1. Field of the Invention

The present invention relates to an improved coal gasification method and apparatus of the type using coal powder.

In view of the recent circumstances about the energy problem, the utilization of coal energy is again in the limelight.

To meet the demand of suppliers and users which have been accustomed to the handy form of the conventionally used energy sources such as petroleum and gases, it has been considered as an urgent necessity to study and solve the problems of coal liquefaction and gasification and many proposals have been made for these purposes. The conventional coal gasification techniques include fixed-bed type fluidized bed methods, jet stream methods and others, and the technique of the present invention comes within the category of the fluidized bed methods. More specifically, the invention is directed to a method in which the reaction temperature region of a fluidized bed is maintained at around 1,100° C. so that an agglomerated bed of fluidized material is formed and thus the gasification furnace capacity and the coal gasification quantity are increased.

2. Description of the Prior Art.

U.S. Pat. No. 3,454,383 discloses a fluidized bed type coal gasification method and apparatus of the above type. In the method and apparatus of this patent, coal having a size of ¼ to ⅜ inches including those greater than 100-mesh size is fed into the neck portion of a vertical gasification furnace having a cooling coil around its outer surface and lined with a refractory material along with its product gas which will be described later. Also, air and sieved pulverized coal of smaller than 100-mesh size are fed into a cyclone furnace along with the gas produced thereby which will be described later and they are then blown by the cyclone furnace into the furnace chamber so as to be burned therein at a combustion temperature of 3,000° F. (1650° C.) and thereby to form a gasification zone as a fluidized bed in the part above the neck portion. The resulting gas and products are introduced into a heat exchanger annexed to the gasification furnace and their sensible heat of 1,800° F. (980° C.) is subjected to heat exchange. The gas and products are then introduced into a dust collector so that the separated char is fed back to the cyclone furnace and a portion of the product gas is also fed back to the combustion system.

However, the above-mentioned known method and apparatus are disadvantageous in that the reaction temperature is low due to the ordinary fluidized bed type and the reaction time is also long due to the coarse and large particle size of the coals.

Known jet-type coal gasification methods includes the Koppers-Totzek method. This method is disadvantageous in that coal must be pulverized so that more than 80% passes through a 200-mesh screen with the resulting increase in cost and that with the furnaces according to the method the rate of gasification (the rate of gasification of coal to reducing gases such as Co and $H_2$ and oxidizing gases such as $Co_2$, etc ,) is as low as about 90%. These defects are attributable to the fact that in order to prevent the fusion of ash to that part of the apparatus serving the purpose of delivering the product gas, the ash amounting to 50 to 90% of the products must be discharged in entrainment with the gas and this results in the formation of unburned carbon.

As a result, when considering any coal gasification method and apparatus, it is desirable that a gas conversion ratio of 95 to 100% is ensured.

SUMMARY OF THE INVENTION

In view of these deficiencies in the prior art, the present invention has been created to overcome the deficiencies, and it is an object of the invention to provide a coal gasification method using coal powder, the method comprising the steps of feeding coal powder, along with oxygen or air and steam, into a reaction chamber, feeding the char produced .in the reaction chamber and recovered or the char and coal as well as air or oxygen and steam into a combustion chamber formed in the lower part of the reaction chamber and burning the same in the combustion chamber so as to maintain the temperature therein at about 1,600° C. and maintaining the temperature in the reaction chamber at 900° to 1,300° C. to form an agglomerated bed of fluidized coal.

It is another object of the invention to provide a coal gasification apparatus using coal powder and adapted for performing such coal gasification method, the apparatus comprising a gasification furnace including a reaction chamber having a lower part forming a throat portion with a slightly reduced diameter and a combustion chamber formed below and connected to the reaction chamber, an injection nozzle mounted in position to inject a raw coal powder as well as oxygen or air and steam into about the middle portion of the reaction chamber, and another injection nozzle mounted in position to inject char or coal with air or oxygen and steam into the combustion chamber.

DESCRIPTION OF THE PREFERRED EMBODIMENT.

Figure 1:
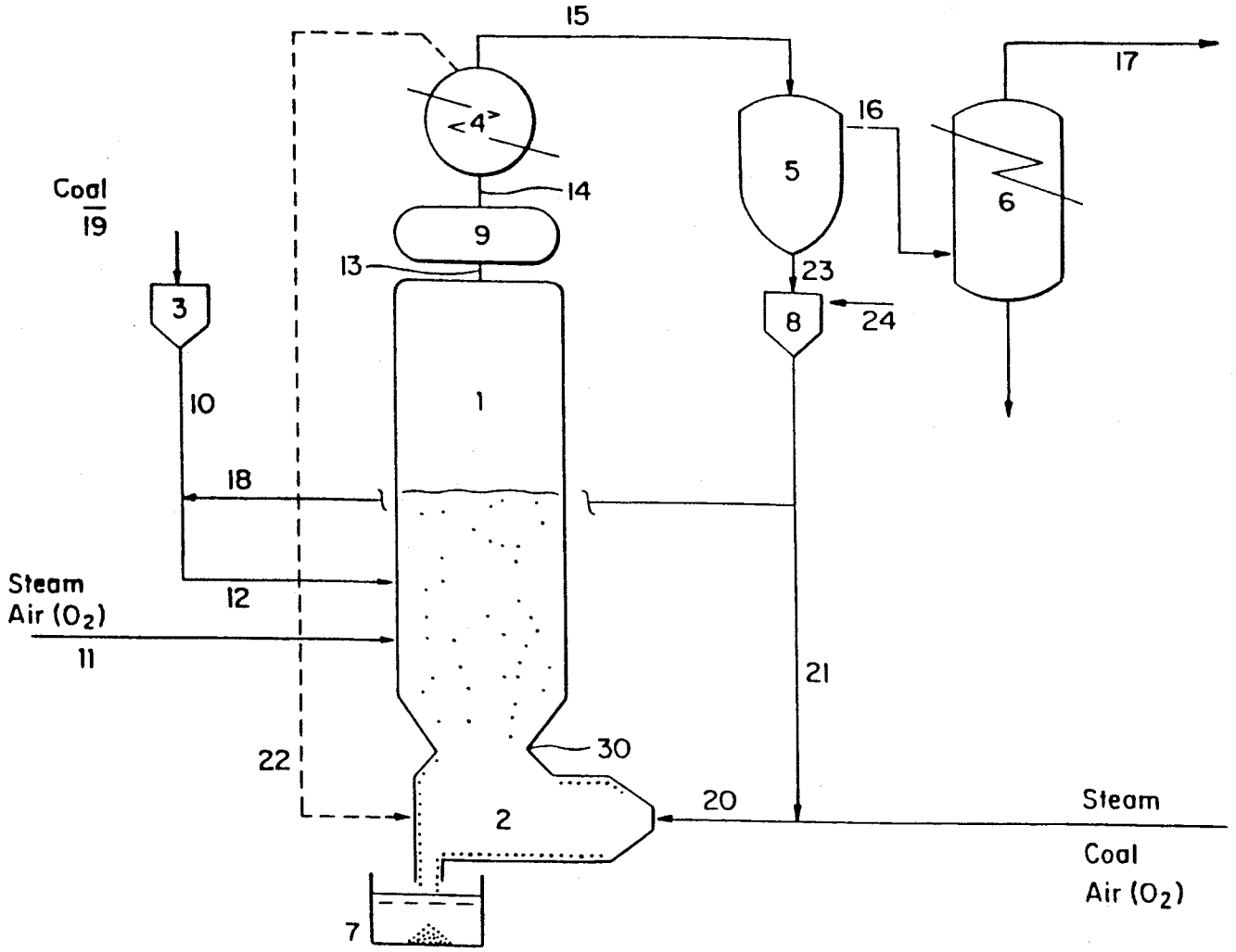
FIG. 1 is a schematic diagram showing an embodiment of a coal gasification apparatus according to the invention.

The coal gasification apparatus using coal powder according to the invention will now be described with reference to the accompanying drawings. In the FIG. 1, numeral 1 designates a reaction chamber having its lower part formed into a throat portion 30 with a slightly reduced diameter, and 2 a combustion chamber connected to the lower part of the reaction chamber 1. The chambers 1 and 2 form a gasification furnace. Numeral 12 & 11 designate a injection nozzles for injecting a coal powder, and oxygen or air and steam, respectively into substantially the middle portion of the reaction chamber 1. Numeral 20 designates an injection nozzle for injecting char or coal with oxygen or air and steam into the combustion chamber 2. Numeral 7 designates an ash receiver provided at the lower part of the combustion chamber 2, and 13, 14 and 15 outlet pipes through which the product gas and products discharged from the reaction chamber 1 are introduced into a dust collector 5. Numeral 23 designates a char delivery pipe for delivering the char and a small quantity of ash separated in the dust collector 5 to a char hopper 8. Numeral 24 designates a coal supply pipe which is used when coal is supplied in addition to the product char from the gasification furnace as will be described later in greater detail. Numeral 21 designates a fuel supply pipe for supplying the char or coal to the injection nozzle 20. Numeral 18 designates an extra char supply pipe by which any excess of the product char is supplied for mixture with a raw coal powder. Numeral 19 designates a coal powder supply pipe for supplying a raw coal pulverized preliminarily to a particle diameter of 2 to 3 mm or less to a coal powder hopper 3, and 10 is a coal powder delivery pipe for supplying the coal powder from the coal powder hopper 3 to the injection nozzle 12.

EXAMPLE 1

The operation of the coal gasification method using coal powder according to the invention will now be described with reference to the illustrated embodiment apparatus. More specifically, coal powder having a particle diameter of less than 3 mm is fed, along with oxygen and steam (the steam is supplied from a boiler which will be described later), into the reaction chamber 1 of the fluidized bed gasification furnace. On the other hand, char (the char recovered and supplied from the dust collector which will be described later) and oxygen and steam (the steam supplied from the previously mentioned boiler) are introduced into the jet combustion chamber 2 formed in the lower part of the reaction chamber 1. In this way, the temperature within the jet combustion chamber 2 is maintained at about 1,600° C. and the temperature within the reaction chamber 1 is maintained substantially at 1,300° C. Numeral 4 designates a waste heat boiler arranged above the fluidized bed gasification furnace and adapted to recover the sensible heat of the product gas of about 800° C. produced and discharged from the fluidized bed gasification furnace. The product gas passing through the waste heat boiler 4 is introduced at a temperature of about 300° C. into the dust collector 5 and then the gas is cooled to about the room temperature in a gas cooling tower 6 from which the gas is delivered for use externally. It is to be noted that in this embodiment the cooled product gas is used as a cooling circulating gas to provide a cooling medium for cooling the equipment in the top of the fluidized bed gasification furnace. The steam generated from the waste heat boiler 4 is supplied in part to the fluidized bed reaction chamber 1 and the jet combustion chamber 2 as mentioned previously and the remaining steam is applied to any external use. While the char separated from the product gas in the dust collector 5 is introduced into the jet combustion chamber 2 as mentioned previously, in this case the ash is also supplied along with the char. The char and ash separated in the gas cooling tower 6 from the product gas passing therethrough are discharged along with the drain from the tower 6.

The flow of the overall process has been described so far and the gasification process of the coal powder within the fluidized bed reaction chamber 1 will now be described.

The char introduced into the jet combustion chamber 2 with the oxygen and steam is first burned by the oxygen and steam and the temperature within the combustion chamber 2 is increased. When the temperature within the combustion chamber 2 is increased so that the temperature of the reaction chamber 1 comes within the reaction enabling temperature region, the coal powder supplied along with the oxygen and steam starts to react and its gasification takes place.

In this case, by maintaining the temperature within the combustion chamber 2 at about 1,600° C., the temperature within the reaction chamber 1 is held within the temperature range between 900° and 1,300° C. which ensures the most efficient operation.

By so doing, the ash is agglomerated within the fluidized bed reaction chamber 1, dropped via the throat portion 30 against the velocity of the gas stream from the jet combustion chamber 2, fused within the combustion chamber 2 and discharged to the ash receiver 7.

In accordance with the above-mentioned method of this invention, the fluidized bed reaction chamber 1 is maintained at a temperature between 900° and 1,300° C. on the ground that by forming an agglomerated fluidized bed within the reaction chamber 1 as mentioned previously, the ash is agglomerated and dropped via the throat portion 30 into the combustion chamber 2 against the upwardly moving gas stream therein instead of allowing all the ash to be entrained and discharged with the product gas as in the case of the prior art technique. To allow this action to take place, temperatures lower than 900° C. are improper since a complete gasification of coal cannot be effected. Also, in general, no agglomerated bed of fluidized material can be formed at temperatures higher than 1,300° C., although there are exceptions depending on the grades of coal. Thus, the previously mentioned temperature range is chosen.

In accordance with an example of the method of this invention, as compared with the calorific value of $6,190\times10^3$ Kcal per ton of raw coal, the recovered calorific value of the product gas was $5,033\times10^3$ Kcal or 81.0% and it was confirmed that the cold efficiency was very high.

The following table shows the computed results of material balance per ton of raw coal in accordance with the method of this invention in the three cases of the jet chamber reducing combustion, the jet chamber oxidizing combustion and the oxidizing combustion of 10% of the pulverized coal of the raw coal supplied to the jet chamber.

| type of combustion | | prerequisites: temperature (°C.) | prerequisites: $Kp = \frac{CO_2 \cdot H_2}{CO \cdot H_2O}$ | Steam requirement (Kg) | $O_2$ requirement (Kg) | amount of gas generation (dry %) Nm³: $H_2O$ | CO | $H_2$ | $CO_2$ | $O_2$ | Total |
|---|---|---|---|---|---|---|---|---|---|---|---|
| jet chamber reducing combustion | jet chamber (per circulating char 0.107 Kg) | 1600 | 0.256 | 0.17 | 0.12 | 0.13 | 0.14 | 0.08 | 0.06 | tr | 0.41 |
| | fluidized bed gasification chamber | 1300 | 0.333 | 0.12 | 0.55 | 0.23 | 1.06 (56) | 0.72 (38) | 0.11 (6) | tr | 2.12 |
| | total (decomposition rate 50%) | | | 0.29 | 0.67 | | | | | | |
| jet chamber oxiding combustion | jet chamber (per circulating char 0.107 Kg) | 1700 | excess $O_2$ | 0.53 | 0.68 | 0.66 | tr | tr | 0.20 | 0.28 | 1.14 |
| | fluidized bed gasification chamber | 1250 | 0.358 | — | 0.04 | 0.50 | 0.93 (49) | 0.75 (40) | 0.22 (11) | tr | 2.40 |
| | total | | | 0.53 | 0.72 | | | | | | |
| oxidizing combustion of 10% of pulverized coal in raw coal supplied to jet chamber | jet chamber (per char 0.107 Kg & raw coal 0.1 Kg) | 1800 | excess $O_2$ | 0.88 | 0.68 | 1.11 | tr | tr | 0.28 | 0.20 | 1.59 |
| | fluidized bed gasification chamber | 1290 | 0.343 | — | 0.09 | 0.89 | 0.81 (43) | 0.76 (40) | 0.33 (17) | tr | 2.79 |
| | total | | | 0.88 | 0.77 | | | | | | |

EXAMPLE 2

Figure 2:
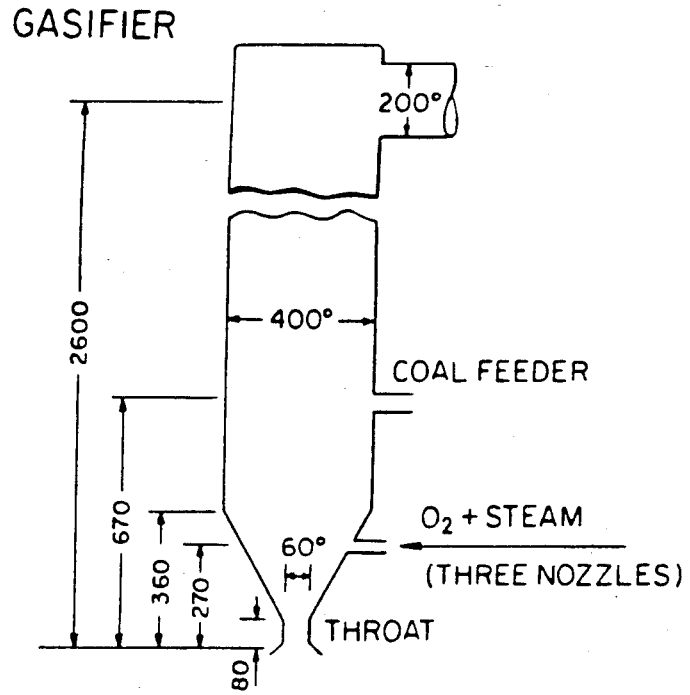
FIG. 2 is an interior view of a reaction chamber showing temperatures and sizes at various parts thereof.

The experimental unit includes a reaction chamber that has a size as shown in FIG. 2. A combustion chamber, an ash agglomerates receiver, a waste heat boiler and a dust collector, is also used.

The reaction chamber has carbon steel shells internally protected by an insulating fiber mat and high alumina refractory; the combustion chamber is further protected by silicon carbide tiles. A propane combustor is provided at the lower part of the ash agglomerating reaction chamber to produce 1200° C. gas to make a spouted bed of char particles. The gas velocity at the throat is maintained at 20–24 m/s (the minimum velocity necessary to keep char particles suspended), The stoichimetric ratio of air-to-propane for combustion is 0.8–1.0. Crush coals (particles larger than 3 mm are removed by a screen) together with fines, are fed to the spouted bed by a screw feeder. Three nozzles are provided in the wall of the reactor to inject a mixture of steam and oxygen. Steam/$O_2$ mol ratio of the injecting gas and coal feed rate are fixed throughout a test run. Bed temperatures are controlled by increasing or decreasing the quantities of the injected gas. Char fines elutriated from the ash agglomerating reaction chamber are collected in a cyclone and stored in drums.

The combustion chamber has two burners by which homogenized mixtures of char fines and oxygen are fed. Jet velocities of the mixtures are maintained larger than the flame propagation velocity (presumably it is 15 m/s). The two burners are mounted face to face.

The char fines and oxygen are mixed in ejectors which are equipped on oxygen lines. The combustion chamber has water filled tanks which seal the bottom of the combustion chamber and receive agglomerates or slag.

The combustion chamber is instrumented with some thermocouples and pressure taps; these sensors are monitored and recorded continuously during the runs for process control and for process analysis.

Safety systems for the char gasifier are carefully designed. A blockage of the feed system of either char fines or oxygen could burst the unit. Pressure drops of feed systems are connected to an auto-shut-off system. Uncontrolled pressure drops shut off oxygen valves and char feeds, and also open a valve in the nitrogen line to purge the gasifier.

Raw gas from the reaction chamber is cooled with steam to 600°–800° C.

Some of the results from the operation at several conditions are shown in the table below.

| | RUN NO. 303 | 508 | 518 | 520 | 521 | 525 |
|---|---|---|---|---|---|---|
| Bed Temperature (°C.) | 1170 | 1070 | 1150 | 1140 | 1140 | 1180 |
| Coal feed rate (kg/h) | 50 | 40 | 60 | 80 | 100 | 70 |
| Injecting gas | | | | | | |
| Steam/$O_2$ (mol/mol) | 1.5 | 1.0 | 1.0 | 1.0 | 1.0 | 0.6 |
| $O_2$ feed rate (Nm³/h) | 21 | 16 | 22 | 25 | 31 | 25 |
| Ash agglomerating ratio* (%) | 5.3 | <1 | 18.2 | 24.9 | 14.2 | 24.0 |
| Agglomerate analysis (%) | | | | | | |
| Carbon | 2.8 | — | 2.2 | 3.3 | 3.7 | 2.2 |
| Ash | 97.2 | — | 97.8 | 96.7 | 96.3 | 97.8 |
| Raw gas composition (dry vol %) | | | | | | |
| $H_2$ | 23.2 | 19.4 | 23.6 | 27.3 | 27.1 | 24.9 |
| CO | 23.3 | 24.4 | 27.9 | 26.9 | 27.7 | 32.8 |
| $CO_2$ | 16.8 | 13.6 | 12.8 | 14.8 | 15.8 | 9.5 |
| $CH_4$ | 4.1 | 1.8 | 1.9 | 2.8 | 2.9 | 1.9 |
| $N_2$ | 32.6 | 40.7 | 32.9 | 28.2 | 26.5 | 30.9 |
| Carbon conversion** (%) | 55.0 | 62.2 | 57.6 | 54.8 | 51.4 | 55.3 |
| Char fines*** (kg/h) | 11.3 | 12.5 | 19.0 | 30 | 36.0 | 19.0 |

*Ash fallen as agglomerates/ash fed with coal
**Carbon gasified/carbon fed with coal
***Caught in cyclone The bed temperatures show that the reaction chamber has a wide range of stable operability. One primary concern was that for a particular coal, the reaction chamber might have to be operated in a narrow range of temperatures. The temperature which is optimum for gas quality and for ash agglomerating conditions could be varied between 1070° C. (1960°) and 1180° C. (2160° F.).

The reaction temperature is controlled by the total feed of steam and oxygen.

A coal feed rate as high as 100 kg/h, or throughputs of 800 kg/m$^2$, is attained. This value, rather high for a fluidized-type reaction chamber operated under atmospheric pressure with bituminous coal, is due to high reaction temperature. At particular gasification conditions, ash agglomeration takes place and large agglomerates fall through the throat of the spouted bed. The agglomerates produced are porous-surfaced, nearly spherical, and range in diameter from 2.5 mm (1/10 in.) to as large as 10 mm (2/5 in.) The ash agglomerating ratio (ash fallen as agglomerates/ash fed with coal) reaches approximately 30% at maximum. The ash agglomerating ratio seems likely to be dependent on bed temperatures and steam/$O_2$ mol ratios of injecting gas. It is very low at bed temperatures of lower than 1070° C. or at steam/$O_2$ mol ratios of larger than 1.5. The quantitative relationship between these operation variables and ash agglomerating ratios are not yet known. The steam/$O_2$ mol ratio of 0.6 could be used to maintain stable operation. This value is much smaller than the 3.0 of a conventional typical fluidized bed reaction chamber which needs excess steam to prevent clinker trouble. It is observed that, in the instance where the temperature in the reaction chamber is maintained, for example, within the range from 1,000° C. to 1,200° C. and the steam and oxygen mol ratio of injecting gas for the reaction chamber is varied, the behavior of separation of agglomerated ash varies as indicated in the following table:

| | | Reaction Temperature °C. | | | | |
|---|---|---|---|---|---|---|
| | | 1000 | 1050 | 1125 | 1175 | 1200 |
| steam/$O_2$ ratio (mol/mol) | 1.0 | X | O | O | O | O |
| | 1.5 | X | X | O | O | O |
| | 2.0 | X | X | X | O | O |

The smaller values require less oxygen to maintain a bed temperature.

Figure 3:
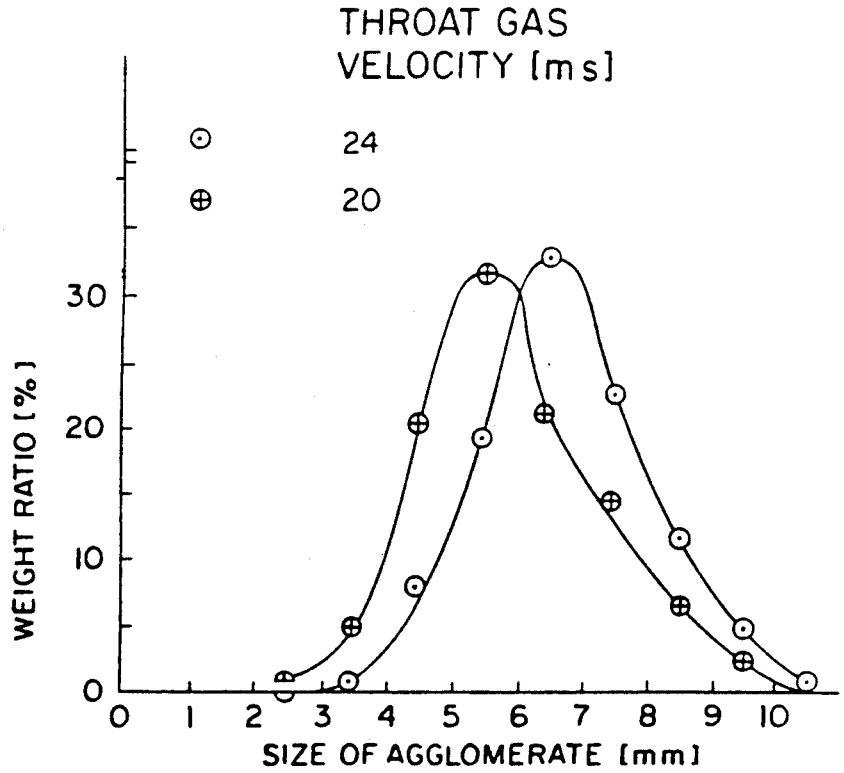
FIG. 3 is a graph showing the weight ratio in percent plotted against the size distribution of agglomerated ash.

Carbon contents of the agglomerates are 2.2–3.7%; these show ash agglomerates almost exclusively in the bed of gasifying char particles. Size distributions of the fallen agglomerates are shown in FIG. 3. Minimum size is 2.5 mm, which is nearly equal to a minimum size 2.9 mm calculated according to Allen's equation for overcoming the lift of the throat gas velocity 20 m/s. The left sides of the size distribution curves are steep; these show the agglomerates fall without any accompanying small char particles. The particle density of an agglomerate is 1.88 g/cm$^3$, larger than 1.1 g/cm$^3$ of char particles. The difference of density makes the agglomerates fall from the char particles bed smoothly. Separations of sticky ashes as agglomerates prevent clinker troubles and realize gasifications of crushed coal at a high temperature which is within 70° C. of the melting point of the ash of the coal used. The high temperature gasifications have several beneficial effects: increasing of throughout rate, and decomposition of tar and oil in the raw gas.

Figure 4:
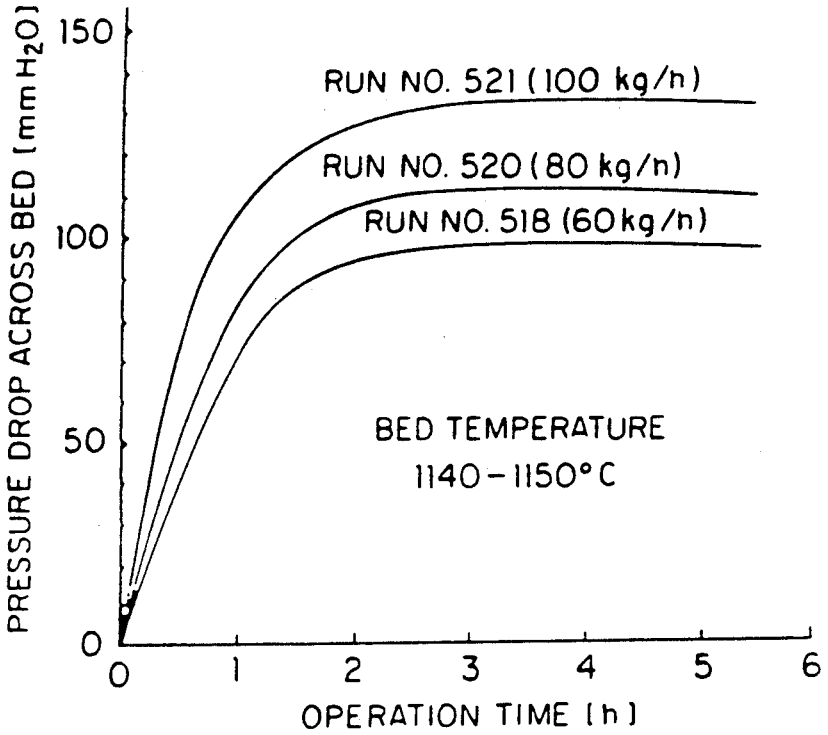
FIG. 4 is a graph showing the pressure drop across the bed versus operation time.

A pressure drop across the spouted bed changes correspondingly to the hold up in the bed. Typical curves of pressure drop versus operating time are shown in FIG. 4. They becomes constant in a few hours of operation, and no accumulation of ash or char particles occurs in the reaction chamber. Coal feed rates exceeding a maximum feed rate which maintains constant hold up would have caused a continual increase of hold up with the operation time. FIG. 4 shows that in excess of 100 kg/h coal feed rate could have been accepted by this reaction chamber, but overloadings on the quench system restricted the feed rate. At steady-state conditions, the amount of ash fed to the reaction chamber is equal to a sum of agglomerates fallen and flying ashes entrained with raw gases.

Carbon dioxide of the raw gas involves the carbon dioxide from the propane combustor. Approximately 25% of the former corresponds to the latter. Nitrogen in the raw gas is mainly from the propane combustor.

Approximately 56% of carbon fed with coal is converted to gas; the remainder is elutriated from the reaction chamber as char fines. Due to the large amount of fines included in the feed coal, the carbon conversion was not high compared with a conventional fluidized bed reaction chamber which was fed narrowly sized coal. The coal gasification process of the invention is expected to achieve high carbon conversion by means of gasification of the elutriated char fines in the combustion chamber.

Figure 5:
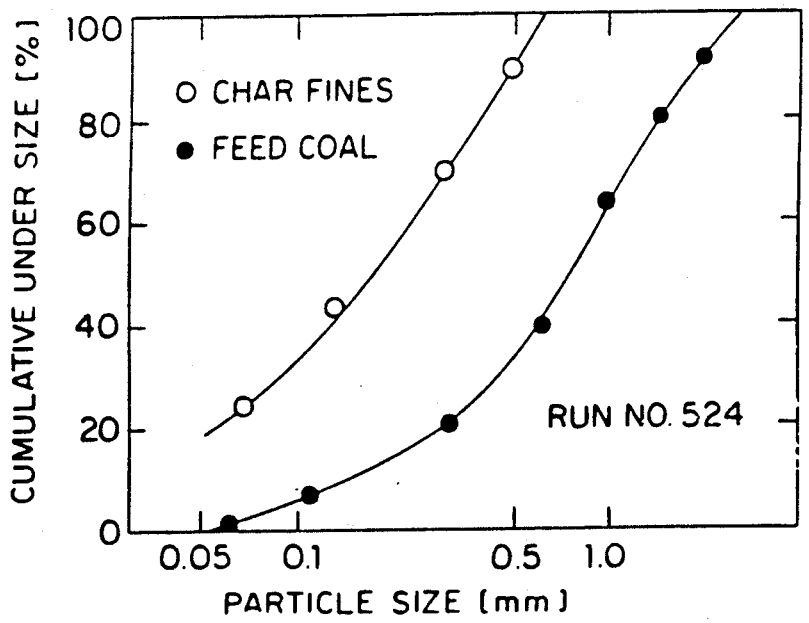
FIG. 5 is a graph showing size distributions for char fines and feed coal.

A cumulative size distribution curve of the char fines of Run No. 524 is shown in FIG. 5; that of feed coal is also shown. A calculated minimum char size which overcomes the lift of the superficial gas velocity 1.7 m/s of Run No. 524 is 0.34 mm. Char fines larger than this size elutriated from the gasifier are due to biased gas flow and amounted to 30–40% of total char fines caught in the cyclone. The large char fines could have been returned in the reaction chamber easily by some means like a spreading inside diameter of the upper part of the reaction chamber. Ash contents of the char fines and bed materials are 20.5% and 24.6% respectively for Run No. 524.

We claim:

1. A coal gasification apparatus comprising:

(a) a gasification furnace consisting essentially of a combustion chamber means for burning combustible materials, a reaction chamber means for reacting coal powder, steam and oxygen or air located above said combustion chamber means, and a throat means having a reduced cross-sectional area relative to each of said combustion chamber and said reaction chamber means for interconnecting said combustion and reaction chamber means;

(b) an ash receiver;

(c) separation means for separating product gas and char produced in said reaction chamber means;

(d) fuel supply means for supplying the separated char to said combustion chamber means;

wherein said reaction chamber means consists essentially of:

(1) first inlet means for introducing into a middle portion of said reaction chamber means, raw coal powder having a particle diameter not greater than 3 mm;

(2) second inlet means for introducing into a middle portion of said reaction chamber means, steam and oxygen or air, wherein the second means is at a point below the first means; and (3) first outlet means for discharging gas and char produced in said reaction chamber means;

wherein said combustion chamber means consists essentially of:

(1) third inlet means for introducing combustible materials together with oxygen or air and steam into said combustion chamber means, for providing a temperature of about 1600° C. within said combustion chamber means and for producing a hot gas stream that passes upwardly through said throat means and into said reaction chamber means; and (2) fourth inlet means for introducing steam into said combustion chamber means; and (3) second outlet means for discharging ash to the ash receiver;

wherein said reaction chamber means reacts said coal powder, steam and oxygen or air at a temperature of from about 900° C. to about 1300° C. under fluidized bed gasification conditions to produce the product gas, char and ash and for agglomerating said ash until said ash attains sufficient size and weight to drop into said combustion chamber means against the velocity of the gas stream passing from said combustion chamber means; and wherein further due to the reduced cross section of said throat means, the hot gas stream accelerates to a gas velocity of at least 20–24 m/s to thereby act as a fluidizing gas to establish the fluidized bed gasification conditions in the reaction chamber means.

2. A goal gasification apparatus according to claim 1, further comprising a second fuel supply means for introducing separated char into said first inlet means.

3. A coal gasification apparatus according to claim 2, further comprising cooling means positioned downstream of said reaction chamber for cooling the product gas and char leaving the reaction chamber to about 300° C. before being separated.

4. A coal gasification apparatus according to claim 3, wherein said cooling means includes a heat exchanger having water as a heat transfer medium to form steam for introduction into the combustion chamber.

* * * * *